United States Patent [19]

Aida

[11] Patent Number: 4,528,707

[45] Date of Patent: Jul. 16, 1985

[54] COMBINATION SCISSORS AND PAPER KNIFE

[75] Inventor: Masaaki Aida, Tokyo, Japan

[73] Assignee: Kabushiki Kaisha Midori, Tokyo, Japan

[21] Appl. No.: 606,455

[22] Filed: May 2, 1984

[30] Foreign Application Priority Data

Jul. 26, 1983 [JP] Japan ..... 58-116945[U]

[51] Int. Cl.[3] ..... B26B 13/22

[52] U.S. Cl. ..... 7/131; 30/122; 30/254; 30/271

[58] Field of Search ..... 30/254, 257, 271, 122; 7/133, 134, 131

[56] References Cited

U.S. PATENT DOCUMENTS

| | | | |
|---|---|---|---|
| 104,996 | 7/1870 | Prang | 7/131 |
| 348,749 | 9/1886 | Kimbler | 7/131 |
| 2,073,460 | 3/1937 | Vosbikian | 30/271 |
| 2,801,467 | 8/1957 | Casanovas | 30/254 |
| 2,852,846 | 9/1958 | Ahlbin | 30/257 X |
| 3,046,655 | 7/1962 | Sproson | 30/254 X |

*Primary Examiner*—Jimmy C. Peters

*Attorney, Agent, or Firm*—Wenderoth, Lind & Ponack

[57] ABSTRACT

A combination scissors and paper knife comprises a pair of scissors members each having a blade and a handle formed integrally with each other through a pivotal portion having a pivotal hole bored therein and a clasp inserted into the pivotal holes in the pivotal portions for pivotally attaching the pair of scissors members to each other, at least one of the backs of the blades having a paper knife edge put thereon. The pivotal portions are provided one each with control portions for regulating the rotation of the blades and also provided on the end faces thereof unconnected relative to the handles one each with segmental surfaces of circles with the pivotal holes as their respective centers adapted to draw a continuous arc when the blades are opened. It is safely used as scissors without pinching fingers etc. between the ricassos and, in its closed state, advantageously used as a paper knife.

3 Claims, 11 Drawing Figures

COMBINATION SCISSORS AND PAPER KNIFE

BACKGROUND OF THE INVENTION

1. Field of the Invention

The present invention relates to scissors which also serve as a paper knife and, more particularly, to a combination scissors and paper knife adapted to also serve as a paper knife in a state wherein the blades thereof overlap each other by putting edges on the backs of the blades.

2. Description of the Prior Art

Generally, scissors are constructed, as illustrated in FIG. 1, by pivotally attaching with a clasp 5 a pair of scissors members each comprising a blade 1, a handle 3 and a connection portion 2 for integrally connecting the blade and the handle, with the rear surfaces of the scissors members brought into intimate contact with each other.

Mere formation of edges on the backs 6 of the blades 1 of the scissors having the construction as described above to obtain a combination scissors and paper knife entails the following disadvantage. When paper knife edges are put on the entire backs 6 of the blades, ricassos (blade butts) 8 on extension of the backs of the blades on the connection portion 2 sides come to have the paper knife edges put thereon. Therefore, when the blades 1 are opened by moving the handles 3 away from each other, the ricassos 8 are also away from each other, thereby entailing a possibility of fingers being pinched between the ricassos 8 and injured. Thus, it is impossible to obtain an advantageous combination scissors and paper knife merely by putting paper knife edges on the backs of the blades.

SUMMARY OF THE INVENTION

The inventor has continued various studies in view of the state of affairs as described above and consequently accomplished the present invention.

The main object of the present invention is to provide a combination scissors and paper knife having a construction such that it can be used safely and advantageously not only as scissors but also as a paper knife.

To attain the aforementioned object according to the present invention, there is provided a combination scissors and paper knife which comprises a pair of scissors members each having a blade and a handle formed integrally with each other through a pivotal portion having a pivotal hole bored therein and a clasp inserted into the pivotal holes in the pivotal portions for pivotally attaching the pair of scissors members to each other, at least one of the backs of the blades having a paper knife edge put thereon, each of the pivotal portions having a control portion formed thereon for regulating the rotation of the blades and also having a segmental surface of a circle with the pivotal hole as the center formed on the end face thereof unconnected relative to the handle, the segmental surfaces on the end faces of the pivotal portions being adapted to draw a continuous arc when the blades are opened.

The aforementioned object and other objects, features and advantages of the present invention will become apparent from the following description given with reference to the accompanying drawings.

DESCRIPTION OF THE PREFERRED EMBOIDMENTS

Figure 1:
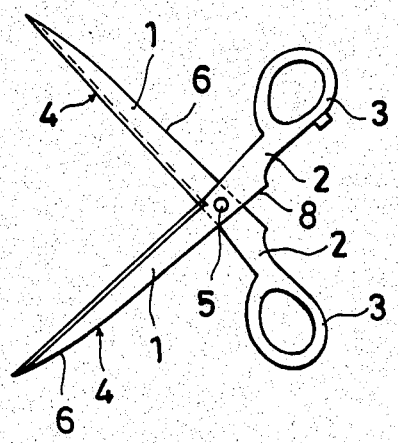
FIG.1 PRIOR ART
FIG. 1 is a front view illustrating prior art scissors.
Figure 2:
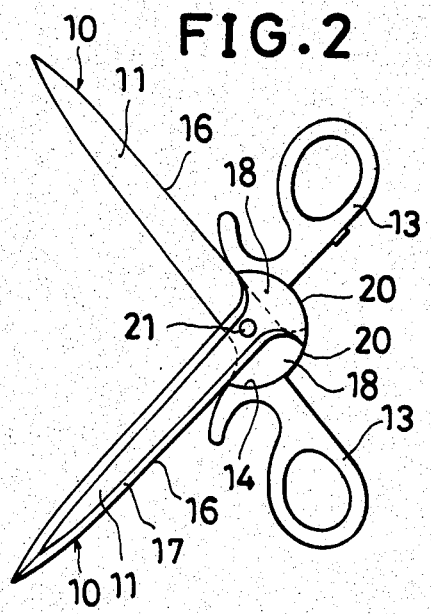
FIG. 2 is a front view illustrating one embodiment of the combination scissors and paper knife according to the present invention.
Figure 3:
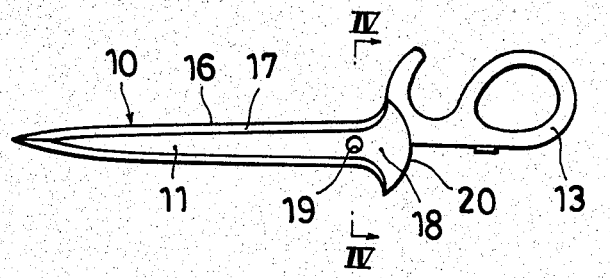
FIG. 3 is a front view illustrating a scissors member of the combination scissors and paper knife.
Figure 4:
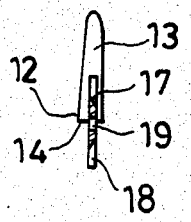
FIG. 4 is a cross-sectional view of the scissors member taken along the line IV—IV in FIG. 3.
Figure 6:
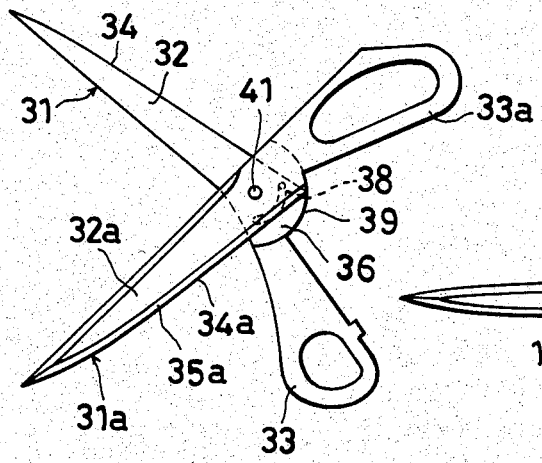
FIG. 6 is a front view illustrating another embodiment of the combination scissors and paper knife according to the present invention.

The present invention will now be described with reference to the illustrated embodiments.

FIG. 2 to FIG. 5 illustrate one embodiment of the combination scissors and paper knife according to the present invention. A scissors member 10 comprises a blade 11 and a handle 13 which are integrally formed so that the handle 13 may constitute approximately one half of the scissors member 10. The handle 13 has a larger thickness than that of the blade 11 to form a stepped portion 12 projecting from the rear surface of the blade 11. The end face of the stepped portion 12 functions as a control portion 14 for regulating rotation of the blades when a pair of scissors members are assembled. The back 16 of the blade 11 has a paper knife edge 17 put thereon, and a pivotal portion 18 of the blade 11 on the handle 13 side has a pivotal hole 19 bored therein. The end face of the blade 11 unconnected relative to and disposed on the side of the handle 13 is formed into a segmental surface 20 of a circle with the pivotal hole 19 as the center.

The combination scissors and paper knife can be obtained by preparing a pair of scissors members 10 having such a construction as described above, bringing the pivotal portions 18 thereof into back-to-back contact with each other so that the pivotal holes may register with each other, inserting a clasp 21 into the pivotal holes 19 and attaching the pair of scissors members 10 pivotally with the clasp 21.

Figure 5:
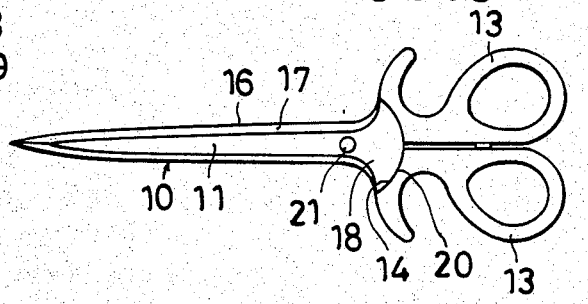
FIG. 5 is a front view illustrating the combination scissors and paper knife in a state assumed when it is used as a paper knife.

Since the backs 16 of the blades 11 have the paper knife edges 17, as described above, when the scissors members 10 are brought to their closed state as illustrated in FIG. 5, the edge of one of the blades 11 and the paper knife edge 17 on the back 16 of the other blade 11 overlap each other. Therefore, the combination scissors and paper knife held in that state can serve advantageously as a paper knife.

When the handles 13 are moved away from each other to thereby open the blades 11, the paper knife edges 17 are brought to collision with the rotation control portions 14, thereby stopping the rotation of the blades 11 and preventing the blades from being further opened. On the other hand, the segmental surfaces 20 formed on the end faces of the pivotal portions 18 are also rotated by moving the handles away from each other. When the blades 11 are prevented from being further opened, however, respective parts of the pivotal portions 18 overlap each other and the segmental surfaces 20 draw a continuous arc, with the result that there is no danger of the fingers etc. being pinched at the pivotal portions 18. Accordingly, the combination scissors and paper knife of the present invention can safely be used as scissors even though the paper knife edges 17 are put throughout the backs 16 of the blades 11.

FIG. 6 through FIG. 11 illustrate another embodiment of the combination scissors and paper knife according to the present invention. Differently from the previous embodiment using a pair of scissors members having one same construction, this embodiment adopts a pair of scissors members of different constructions which constitute scissors for use in cutting cloth, i.e. so-called cutting shears.

Figure 7:
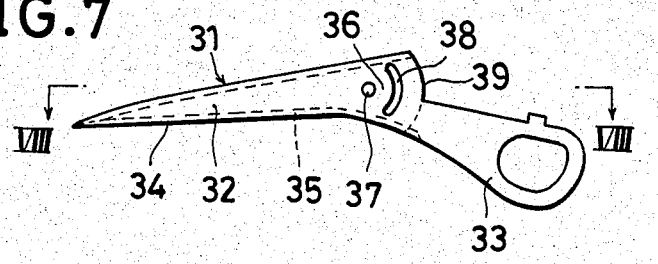
FIG. 7 is a rear view illustrating one scissors member of the embodiment shown in FIG. 6.
Figure 8:
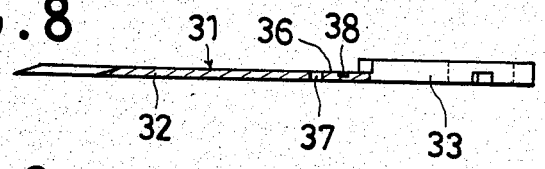
FIG. 8 is a cross-sectional view of the scissors member taken along the line VIII—VIII in FIG. 7.

One of the scissors members 31 comprises, as shown in FIGS. 7 and 8, a blade 32 and a handle 33 which are integrally formed with each other. On the back 34 of the blade 32 is put an edge 35 for a paper knife, and a pivotal portion 36 on the handle 33 side has a pivotal hole 37 bored therein. Further, an arc-shaped groove 38 is formed in the rear surface of the pivotal portion 35 which becomes a contact surface so as to function as a control portion for regulating blade rotation. The arc of the arc-shaped groove 38 is drawn with the pivotal hole 37 as the center. The end face of the pivotal portion 36 unconnected relative to the handle 33 is formed into a segmental surface 39 of a circle with the pivotal hole 37 as the center.

Figure 9:
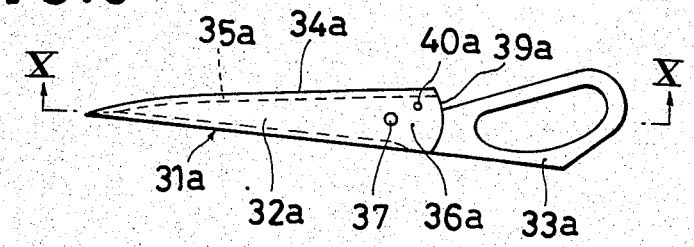
FIG. 9 is a rear view illustrating the other scissors member of the embodiment shown in FIG. 6.
Figure 10:
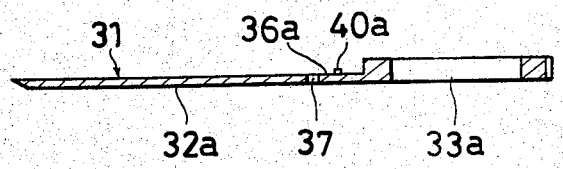
FIG. 10 is a ross-sectional view of the scissors member taken along the line X—X in FIG. 9.

The other scissors member 31*a* comprises, as illustrated in FIGS. 9 and 10, a blade 32*a* and a handle 33*a* which are integrally formed with each other. An edge 35*a* for a paper knife is put on the back 34*a* of the blade 32*a*. A pivotal portion 36*a* has a pivotal hole 37 bored therein so as to register with the pivotal hole 37 of the pivotal portion 36 and also has a protuberance 40*a* projecting from the rear surface thereof which becomes a contact surface and having a size capable of being inserted into the arc-shaped groove 38 of the scissors member 31 when assembled into scissors in conjunction with the scissors member 31*a* so as to function as a control portion for regulating the rotation of the blades 32 and 32*a* in cooperation with the arc-shaped groove 38. The end face of the pivotal portion 36*a* unconnected relative to the handle 33*a* is formed into a segmental portion 39*a* of a circle with the pivotal hole 37 in the pivotal portion 36*a* as the center.

A combination scissors and paper knife is assembled by bringing the scissors members 31 and 31*a* into back-to-back contact with each other to allow the pivotal holes 37 to communicate with each other, inserting a clasp 41 into the matched pivotal holes 37, and pivotally attaching the scissors members to each other with the clasp 41.

Figure 11:
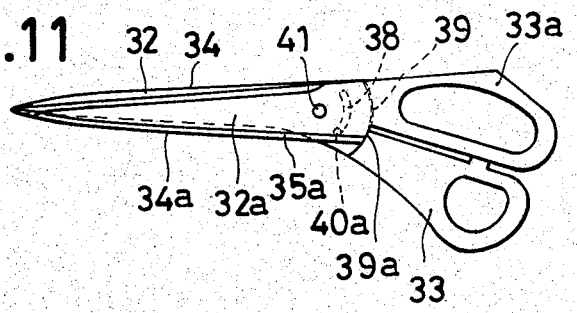
FIG. 11 is a front view illustrating the combination scissors and paper knife of FIG. 6 in a state assumed when it is used as a paper knife.

With the construction of the embodiment as described above, the combination scissors and paper knife can be used as a paper knife when the blades 32 and 32*a* are closed to allow the paper knife edges 35 and 35*a* to overlap the edges of the blades 32*a* and 32 respectively as illustrated in FIG. 11.

Even when the blades 32 and 32*a* are opened in use as scissors, since the rotation of the blades is regulated by the control portions composed of the arc-shaped groove 38 and the protuberance 40*a*, the blades can only be opened at a prescribed angle. Further, the segmental portions 39 and 39*a* of the pivotal portions 36 and 36*a* are rotated with the pivotal holes 37 as their respective centers and, when the rotation of the blades are prevented by the control portions, respective parts of the pivotal portions are allowed to either continue or slightly overlap each other. Therefore, the segmental portions 39 and 39*a* draw a continuous arc. Thus, the combination scissors and paper knife in this embodiment can safely be used as scissors without pinching fingers etc. at the segmental portions.

In the aforementioned embodiments, each of the backs of the blades has the paper knife edge put thereon. However, a paper knife edge may be put on either one of the backs of the blades.

As described so far, according to the present invention, since the paper knife edge is put on substantially the entire area of the back of the blade, the combination scissors and paper knife can advantageously be used as a paper knife in its closed state. Further, since the open angle between the blades can be retained constant and since the end faces of the pivotal portions are formed into concentric segmental surfaces which draw a continuous arc, the combination scissors and paper knife can safely be used as scissors without injuring fingers by pinching in spite of the fact that the paper knife edge is put on substantially the entire area of the back of the blade. Thus, the present invention can provide a considerably effective combination scissors and paper knife from a practical point of view.

What is claimed is:

1. In scissors comprising a pair of scissors members each having a blade and a handle formed integrally with each other through a pivotal portion having a pivotal hole bored therein, and assembled by bringing the pivotal portions of said pair of scissors members into back-to-back contact with each other, inserting a clasp into the pivotal holes in the pivotal portions and pivotally attaching said pair of scissors members with said clasp, a combination scissors and paper knife which comprises a paper knife edge put on at least one of the backs of the blades, control portions formed one each on the pivotal portions for regulating rotation of the blades, and segmental surfaces of circles with the pivotal holes as their respective centers formed one each on the end faces of the pivotal portions which are unconnected relative to the handles, and adapted to draw a continuous arc when the blades are opened.

2. The combination scissors and paper knife according to claim 1, wherein said control portions comprise stepped portions projecting from the rear surfaces of the blades.

3. The combination scissors and paper knife according to claim 1, wherein said control portions comprise an arc-shaped groove formed in the rear surface of one of the pivotal portions and a protuberance formed on the rear surface of the other pivotal portion and inserted into said arc-shaped groove.

* * * * *